US005833334A

United States Patent [19]

Harper

[11] Patent Number: 5,833,334

[45] Date of Patent: Nov. 10, 1998

[54] ORGANIZER FOR HOME ENTERTAINMENT ACCESSORIES

[76] Inventor: Dale Harper, 51705 Avenida Villa, La Quinta, Calif. 92253

[21] Appl. No.: 852,343

[22] Filed: May 7, 1997

[51] Int. Cl.[6] ..... A47B 43/00

[52] U.S. Cl. ..... 312/257.1; 312/265.6; D19/78; D6/476; D6/467

[58] Field of Search ..... 312/257.1, 9.53, 312/9.54, 9.55, 9.56, 263, 265.5, 265.6; D6/449, 467, 476; D19/78; 211/11; 206/307.1, 576, 579

[56] References Cited

U.S. PATENT DOCUMENTS

| | | | |
|---|---|---|---|
| D. 242,601 | 12/1976 | Sato . | |
| D. 249,273 | 9/1978 | Day | D19/78 |
| D. 283,474 | 4/1986 | Appel | D6/467 X |
| D. 316,347 | 4/1991 | Getto | D6/467 |
| D. 316,565 | 4/1991 | Rust | D19/78 X |
| D. 317,178 | 5/1991 | Kheng | D19/78 X |
| D. 324,144 | 2/1992 | Watrous | D6/476 |
| D. 335,976 | 6/1993 | Brown | D6/449 |
| D. 337,672 | 7/1993 | Doria | D6/466 |
| D. 348,692 | 7/1994 | Hou | D19/78 X |
| D. 360,780 | 8/1995 | Kennedy, Jr. | D6/449 |
| 3,669,131 | 6/1972 | Parker . | |
| 4,103,981 | 8/1978 | Donahue et al. | 312/265.6 |
| 4,394,055 | 7/1983 | Smith | 312/9.54 X |
| 4,712,693 | 12/1987 | Striplin | 211/164 |
| 5,176,435 | 1/1993 | Pipkens | 312/265.6 X |
| 5,244,173 | 9/1993 | Kulyk | 248/176.1 |
| 5,454,633 | 10/1995 | Nemeth | 312/9.54 |

*Primary Examiner*—Peter M. Cuomo
*Assistant Examiner*—James O. Hansen
*Attorney, Agent, or Firm*—Dennison, Meserole, Pollack & Scheiner

[57] ABSTRACT

An assemblage of components including a selectively combinable compartmented tray, underlying shelf, overlying cover and interchangeable sets of side panels. The side panels conform to and mount with the three major components in accord with the particular components to be assembled. The shelf and cover, when individually or in combination mounted to the compartmented tray, being pivotally adjustable relative thereto.

17 Claims, 6 Drawing Sheets

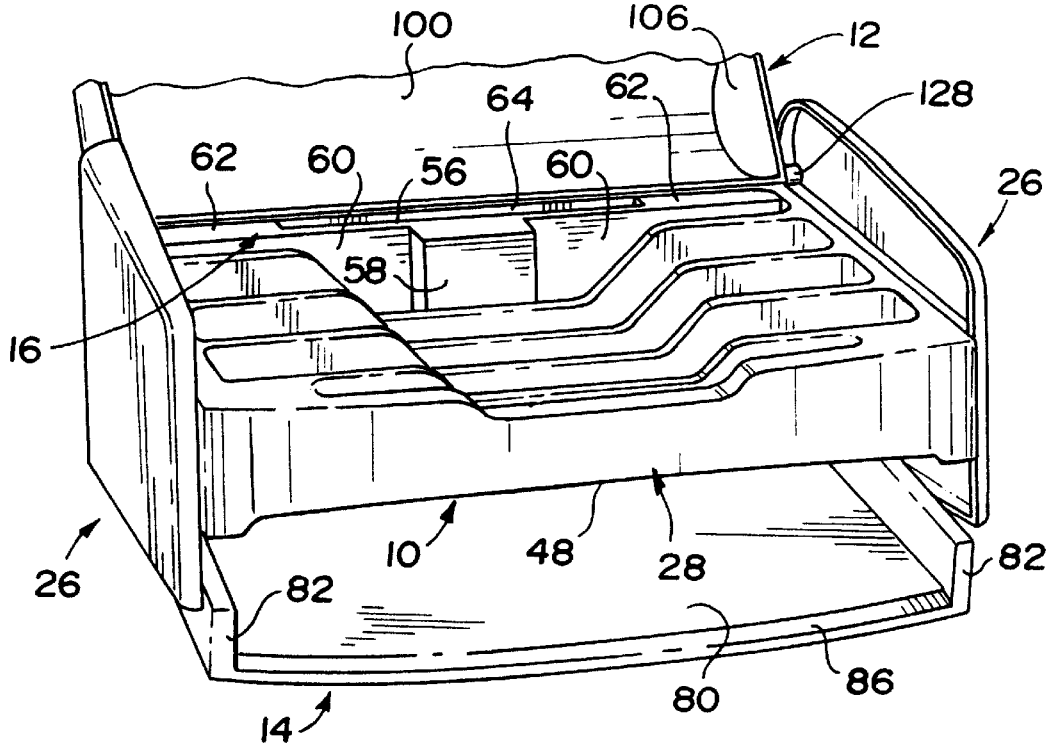
FIG. 8
FIG. 7
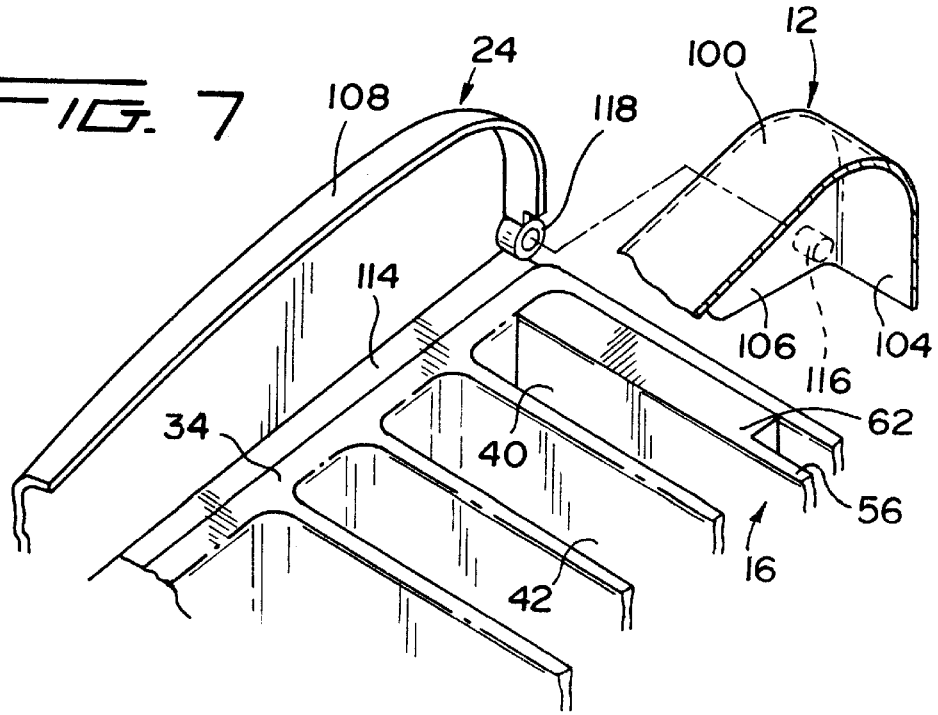

ORGANIZER FOR HOME ENTERTAINMENT ACCESSORIES

BACKGROUND OF THE INVENTION

Remote control organizers have become increasingly more popular as the use of remote controls for television, VCR's, and the like, expand. Known organizers, of which there are a substantial number, take many forms, all of which include some means to support or confine one or more remote controls. This, in many instances, will merely comprise an open receptacle.

However, inasmuch as the normal TV viewer will frequently find it convenient to have other items, which might also broadly be considered as TV accessories, readily available, the usual organizer, concerned principally with remote control units, has not been found to be adequate. Basically, known organizers, while accommodating remote control units, do not adequately provide for TV program magazines, programming manuals, writing or note pads, pens and/or pencils, drink coasters, and the like.

In addition, known organizers lack any significant ability to, through the use of auxiliary components in the manner of a kit, expand or be modified to in effect provide a customized organizer for individual purchasers.

SUMMARY OF THE INVENTION

The organizer of the present invention includes a tray which, in its basic form, includes multiple pockets or compartments specifically defined for the accommodation of multiple remote controls in a manner which allows for a stable retention and separation of the controls, clear visibility of the controls, and easy access to the controls.

The tray, while comprising a self-contained practical and highly usable unit, can be readily customized by the selective addition of a variety of components which easily mechanically assemble thereto without the use of tools. The addition of the various components provide in effect customized organizers which, at the option of the user, can include an underlying shelf for one or more TV magazines or guides, a cover to overlie and enclose the tray to protect the controls from dust, accidental spillage, or the like, an internal divider for partitioning one of the compartments into multiple chambers for specialized use, and any combination of these features.

In achieving the versatility of the invention, interchangeable side panels, which are the only external components mounted directly to the tray, are provided to selectively mount the shelf or cover, or both, in close, working proximity to the tray. Several different size side panels are provided, each configured to accommodate a specific component or components, providing in each instance an attractive finished product.

BRIEF DESCRIPTION OF THE DRAWINGS

FIG. 7 is a partial perspective exploded detail illustrating the manner in which the cover is pivotally mounted to the side walls;

FIG. 8 is a perspective view, partially broken away, illustrating the organizer with the side panels mounting both a pivoting underlying shelf and the cover, the tray also containing the divider in the rearmost compartment thereof;

DESCRIPTION OF PREFERRED EMBODIMENTS

Figure 1:
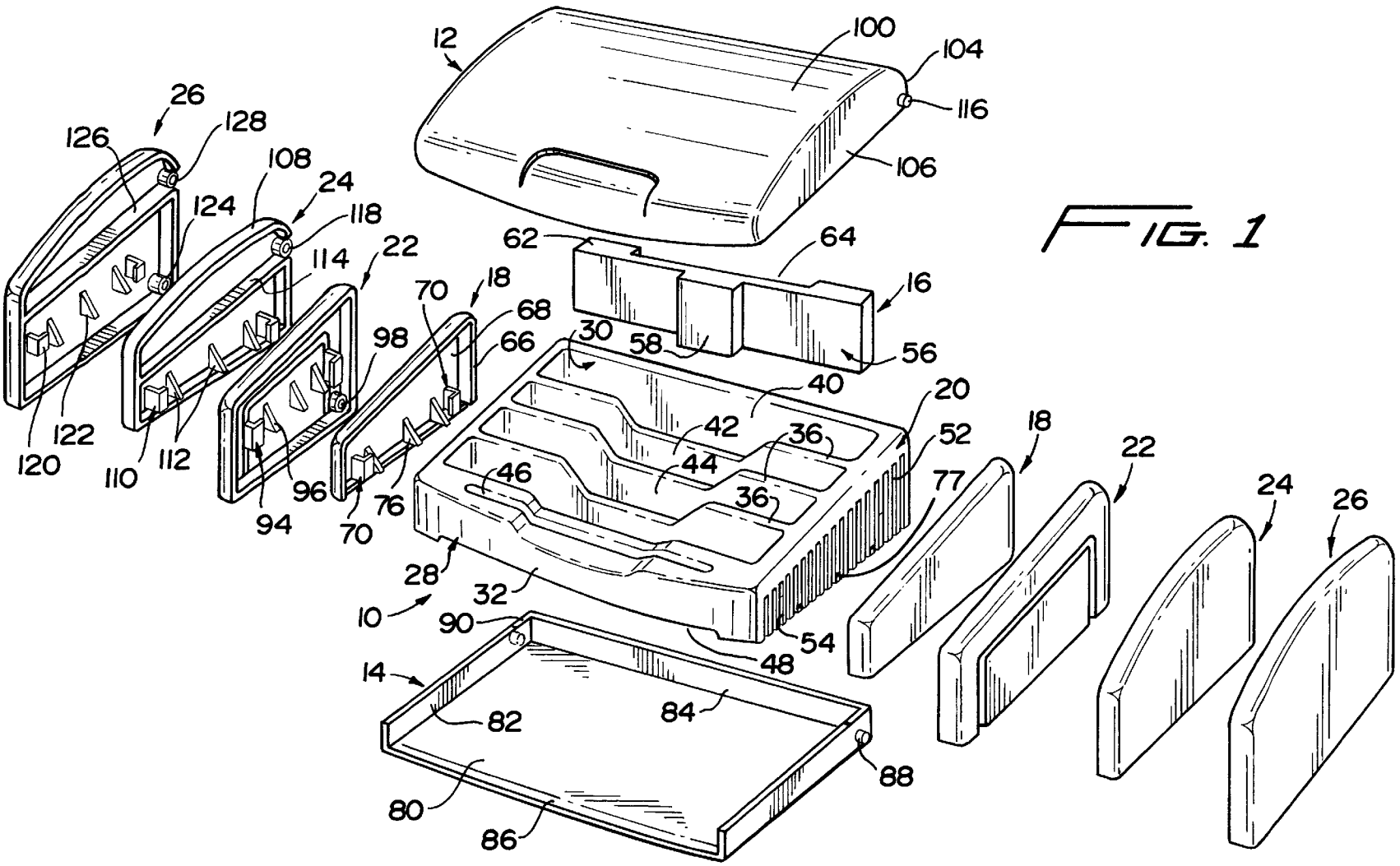
FIG. 1 is an exploded view of the components of the invention.

Referring now more specifically to the drawings, FIG. 1 illustrates all of the components of the overall assemblage or kit which, through selective manual engagement of selected ones of the components, enable the assembly of several unique organizers, thus providing for a customizing of organizersto the individual purchasers.

The components include a basic compartmented tray 10, a cover 12, an underlying magazine shelf 14, a compartment divider 16, and four sets of side panels. The sets of side panels include a first set of side panels 18 mountable to the opposed side walls 20 of the tray 10 and of generally equal size and configuration as the corresponding side walls.

The second set of side panels 22 similarly mount to the opposed side walls 20 of the tray 10 and depend therebelow to, in turn, mount the underlying shelf 14. The third set of side panels 24, similarly mounted to the tray side walls 20, extend vertically above to receive and mount the pivoting cover 12 therebetween. The fourth set of side panels 26, mountable to the tray side walls 20, extend both vertically thereabove and vertically therebelow to mount both the overlying cover 12 and the underlying shelf 14.

Turning now to the individual components, the tray 10 includes opposed front and rear walls 28 and 30 joined to and extending between the opposed side walls 20 to define a generally rectangular configuration with the lower edges of the opposed side walls 20 and the rear wall 30 being coplanar and forming a base. The front wall 28 has a slightly convex forward face 32, and along a major portion of the lower edge thereof, is upwardly recessed with the edge, at the opposed end portions thereof, being coplanar with the lower edges of the side and rear walls.

The rear wall 30 is higher than the front wall 28. As an example, in a tray of a side-to-side width of approximately 10" and a front-to-rear depth of approximately 7.75", the front wall can be approximately 1.5" high, and the rear wall approximately 2.5" high. The side walls 20 each include an inclined linear upper edge 34 whereby the side walls progressively increase in height from the front wall 28 to the rear wall 30.

In the preferred form of tray, three elongate parallel intermediate walls 36 are joined to and extend between the side walls 20 at spaced points between the front and rear walls 28 and 30. The intermediate walls 36 define four parallel compartments, a front compartment 38, a rear compartment 40, and two intermediate compartments 42 and 44. The intermediate walls 36 are progressively higher from front to rear of the tray with the upper edge of each of these intermediate walls for a substantial portion of the length thereof toward the opposed ends, being of equal height with the adjoining portions of the side wall upper edges 34 and combining therewith to define a common inclined plane. The upper edge of the central portion of each of the intermediate walls 36 and the front wall 28 have an elongate recess provided therein, both to facilitate a viewing of the contents of the compartments immediately rearward thereof, and to facilitate access to such contents.

The front wall 28 of the tray 10 is thicker than the intermediate and rear walls, and has an elongate pen pocket 46 defined longitudinally therein. The pen pocket extends across the central transverse recess in the front wall upper edge and therebeyond. Noting in particular FIG. 10, the pocket 46, to the opposite sides of the recess, is at full depth to positively secure a pen or other writing implement. At the same time, the transverse recess in the front wall substantially completely exposes the central portion of the writing implement for easy access thereto.

Figure 11:
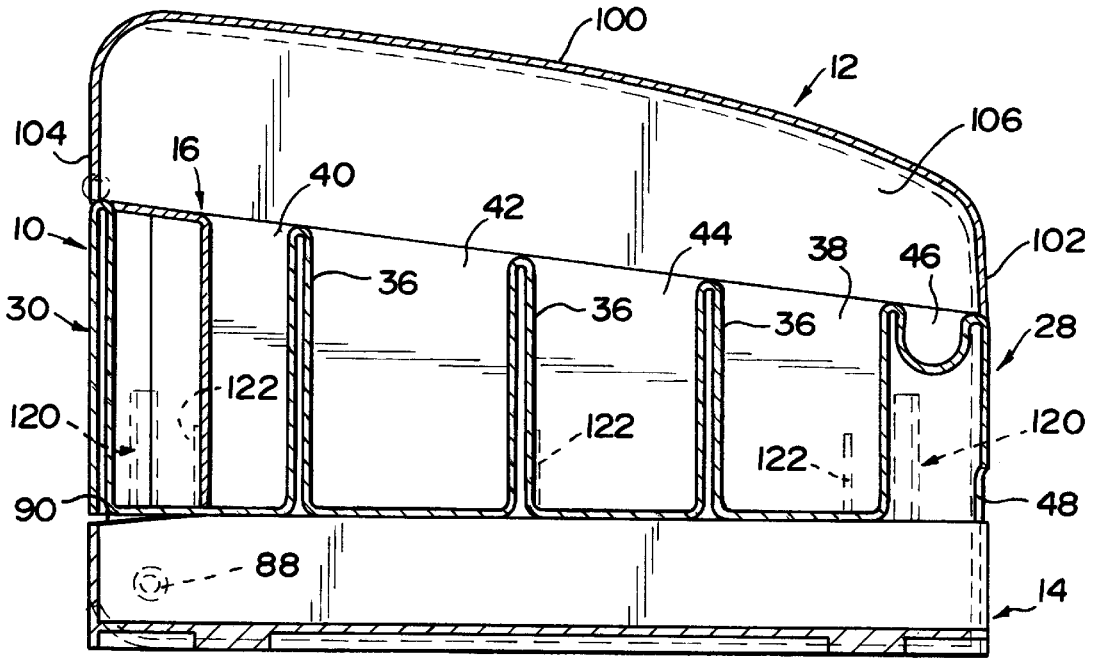
FIG. 11 is an enlarged cross-sectional detail taken substantially on a plane passing along line 11—11 in FIG. 9.

Noting the cross-sectional view of FIG. 11, it will be appreciated that the tray 10 is a unitary molded item, preferably of clear dark smoke tint styrene acrylic-nitrate. In fact, the same or a similar synthetic resinous materials will be used for all of the components. In molding the tray, it will be seen that the front, rear and intermediate walls are actually defined by parallel panels. The side walls 30 are similarly formed by a panel outwardly spaced from the interior end walls of the compartments. The front panel of the front wall 28 is forwardly convex to define the arcuate convex front face 32 of the front wall 24, and includes a recess 48 formed in the lower edge thereof for substantially the full length thereof other than for opposed end portions. As will also be noted in FIG. 11, the flat bottoms 50 of the compartments, including the front and rear compartments, are coplanar or slightly above the lower edges of the side walls 20, rear wall 30, and at least the opposed end portions of the front wall 28. These flat bottoms 50 will preferably mount four elastomeric feet to prevent sliding and/or marring of furniture surfaces.

The opposed side walls 20 of the tray 10 each has, on the outer face or surface thereof, a series of vertically extending alternating ribs and grooves 52 of gradually increasing height and of equal spacing from front to rear for a major portion of the length of the wall. In order to provide for a mounting of the side panels 18–26 to the side walls 20, each side wall includes a pair of vertical slots 54 extending upwardly from the lower edge thereof within selected ones of the vertical grooves at spaced points along the length of the side walls toward the front and rear walls of the tray. The positioning of the slots within the grooves, the slots being of substantially equal width with the grooves, tends to disguise the presence of the slots 54 should one wish to use the tray 10 without side panels.

Referring again to the compartments, the rear compartment 40 is larger than the three compartments forward thereof, and is particularly adapted to receive the divider 16 as a removable component therein. The divider 16 includes a longitudinally extending partition 56, a central partition 58 projecting laterally from the longitudinal partition 56 centrally thereof to form, when inserted in the rear compartment 40, a pair of separate longitudinally aligned chambers 60 between the longitudinal partition of the divider and the intermediate chamber-forming wall 42 immediately forward thereof. The divider 16 also includes a pair of end partitions 62 extending laterally from the opposed side of the longitudinal partition 56 from the central partition 58 and defining therebetween, and in conjunction with the rear tray wall 30, an elongate rear chamber 64 within the rear compartment 40. As will be noted in FIGS. 8 and 10, the removable divider 16 extends for the full length of the compartment 40 with the chambers providing a convenient storage means for drink coasters 66, note pads, and the like.

Figure 2:
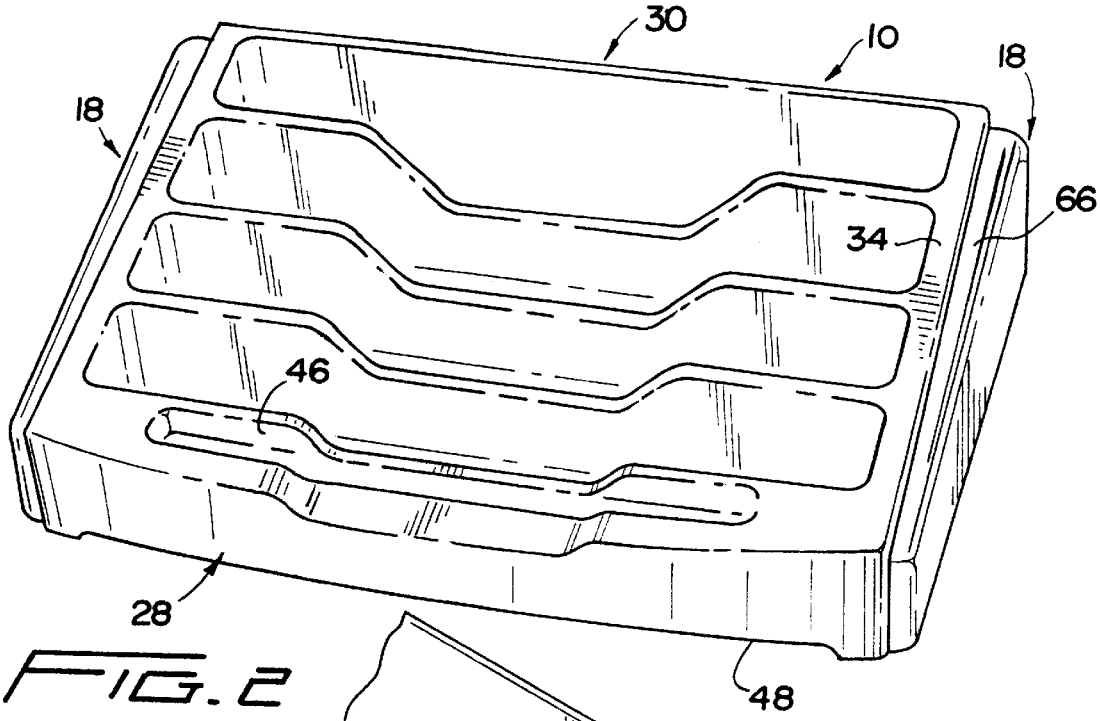
FIG. 2 is a perspective view of the compartmented tray with a pair of side panels mounted thereon.
Figure 3:
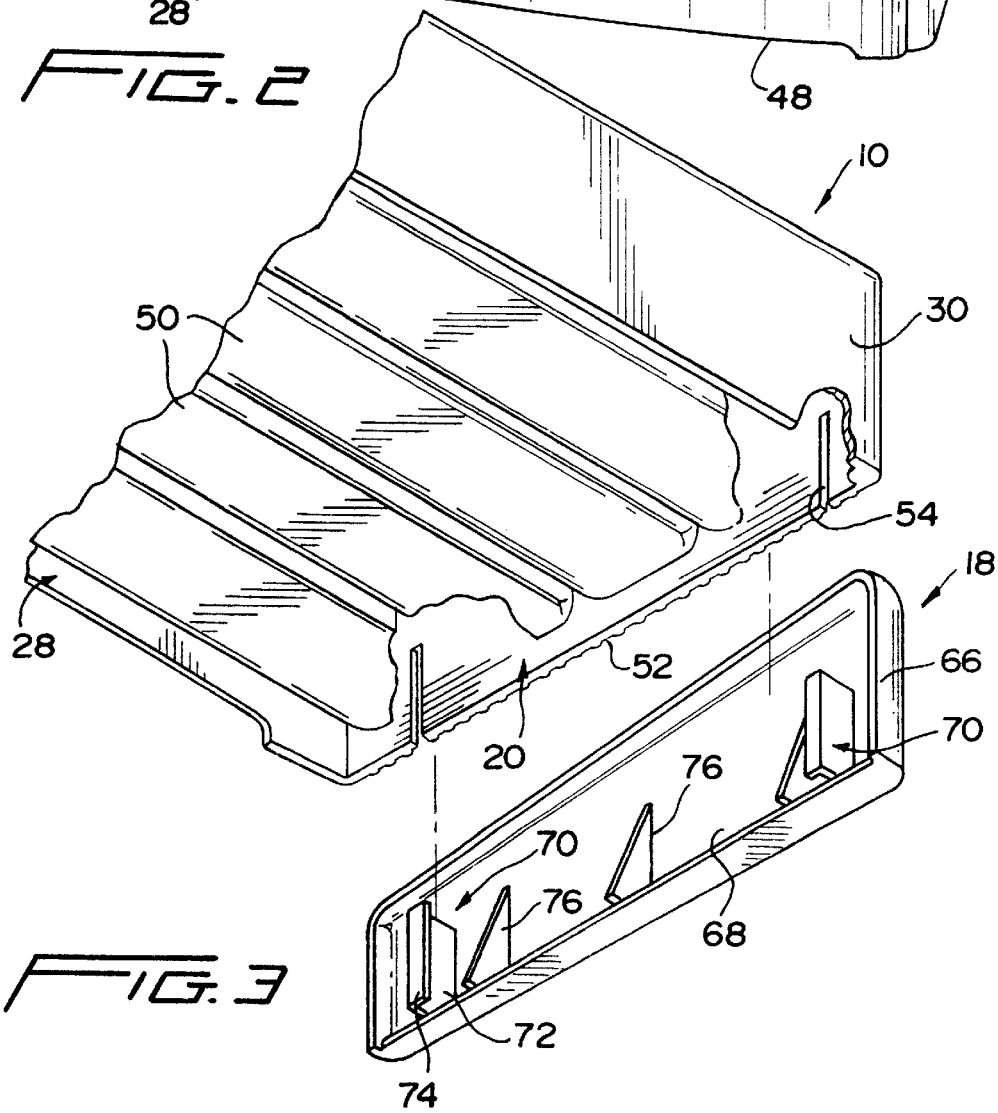
FIG. 3 is an enlarged exploded view illustrating the manner in which the side panels mount.

As noted in FIGS. 2 and 3, the basic tray 10 can be enhanced by the mounting of the first set of side panels 18 to the opposed side walls 20 for a strengthening of the side walls and an enlargement of the bottom or base surface of the assembly. In addition, the outer surface of the side panels 18, or for that matter any of the side panels illustrated, can be provided with a variety of decorative motifs, note for example the accent groove in the outer face of panels 22 which generally parallels the sides and top edge thereof.

Structurally, each side panel 18 includes an inwardly directed integral peripheral flange 66 adapted to be positioned parallel to and adjacent the peripheral edges of the corresponding side wall 20. The back or inner face 68 of each panel 18 includes a pair of vertically elongate L-shaped mounting brackets 70 rigid therewith and extending longitudinally upward from the lower flanged edge of the side panel 18 to a height equal to or slightly less than the height of the side wall slots 54 which are to receive the brackets. Each of the brackets 70 includes a flat plate 72 extending from the inner face 68 beyond the side panel edge flange 66, terminating in a laterally turned outer edge extension 74. The width of the plate 72 is such as to be closely although freely receivable within a corresponding slot 54, with the spacing of the mounting brackets being such as to align the brackets with the slots. When so aligned, the side panel 18, immediately adjacent the corresponding side wall 20, is upwardly moved relative thereto so as to engage the bracket flat plates 72 within the slots with the laterally turned edge extensions 74 lying against the inner face of the side wall 20. These edge extensions 74, depending on the location of the bracket, may extend for only a portion of the height of the associated flat plates 72. As will be recognized, in order to facilitate mounting of the side panels 18, there should be some relatively free sliding movement of the brackets 70 into the slots 54. However, when once mounted, the side panels 18 should be fixed to the side walls in a manner which provides for a positive joiner therebetween whereby the possibility of accidental disengagement is minimal or nonexistent, while at the same time allowing for an intentional disengagement by the application of specific manual pressure.

Figure 4:
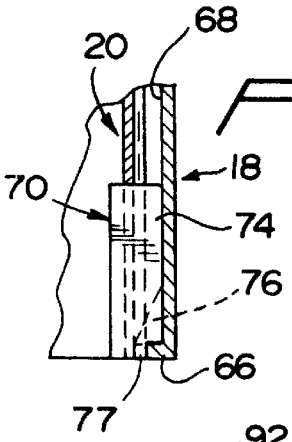
FIG. 4 is an enlarged sectional detail illustrating the interaction between the elements mounting a side panel.

The desired positive engagement is achieved by the use of two or more cams or camming wedges 76. It is preferred that three such wedges be provided on each panel between the brackets, one adjacent each of the mounting brackets 70 and one centrally between the mounting brackets at approximately the midpoint of the side panel. The cams 76 are vertically elongate and extend outward from the inner face 68 of the corresponding side panel 18 to provide a camming edge inclining from a lower end positioned slightly outward from the lower side panel flange but inward of the mounting bracket extensions 74, to an upper end which meets the panel face 68. The lateral distance between the maximum projecting lower end of the outer camming edge of each cam 76 and the laterally turned outer extensions 74 of the brackets 70 is such as to provide the desired positive clamping of the side panels 18 to the side walls 20, note FIG. 4. Basically, as the side panel 18 is moved upward relative to the corresponding side wall 20, the bracket plates 72 engage within the slots 54 with the laterally turned extensions 74 riding along the inner face of the side wall 20. The outer edges of the cams 76 align with and, as relative upward movement of the side panels 18 continues, progressively engage within aligned grooves 52 in the outer surface of the side wall 20 causing a relative movement of the side wall and bracket extensions 74 toward each other until a positive and substantially fixed engagement is achieved with the side panel 18 snugly engaged against the outer surface of the side wall 20 and with the bracket extensions 74 similarly engaged with the inner face of the side wall. The configuration of the camming edges of the cams 76 are such as to bring this positive engagement into effect as the side panel 18 assumes its fully seated position in alignment with the side walls 20, such normally being with the bottom flange of the side panel coplanar with the base or lower extremity of the side wall and tray. Each groove receiving a cam includes a small knob 77, note FIG. 4, at the cover end thereof. The cam, upon a full seating thereof, engages over the knob 77 for a locking engagement therewith.

Turning now to the selectively usable magazine shelf 14, the shelf is basically a rectangular component of a width and length substantially equal to that of the base tray 10. The shelf 14 includes a planar bottom panel 80 with substantially equal height side walls 82 and a rear wall 84. As desired, elastomeric feet can also be provided on the bottom panel. The forward longitudinal edge of the shelf 14 is open with the bottom panel 80 slightly tapered at this forward edge as indicated by numeral 86. Each of the shelf side walls 82, at a point approximate at but not immediately adjacent the rear end thereof, includes a laterally outwardly projecting pivot pin 88. This pin, for enhanced strength, can have a cross section in the nature of a cross. The upper edge of each of the side walls 82 from a point at or slightly forward of the pivot pins 88, inclines slightly rearward as an accommodation for the limited pivotal movement between the tray 10 and the shelf 14 as will be noted in FIGS. 11 and 12 and as will be described subsequently. The shelf rear wall 84 is of equal height with the rear ends of the side walls 82, and hence slightly shorter than the major forward portions of the side walls 82.

Figure 6:
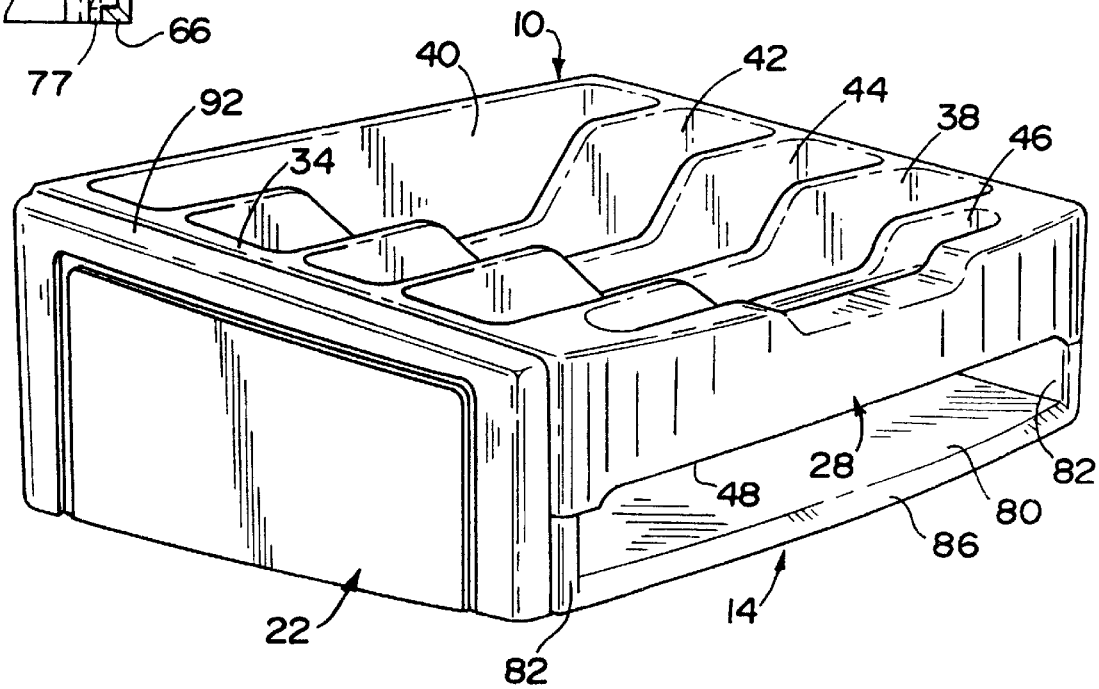
FIG. 6 is a perspective view of the organizer with an underlying shelf.

FIG. 6 is an assembly view of the base tray 10, shelf 14, and side panels 22. The peripheral upper edges of the shelf side walls 82 and rear wall 84 are coextensive with the tray side walls 20 and the rearmost wall panel of the tray for a direct alignment of the tray 10 over the shelf 14 with the tray side walls 20 engaging on the shelf side walls 14.

Figure 12:
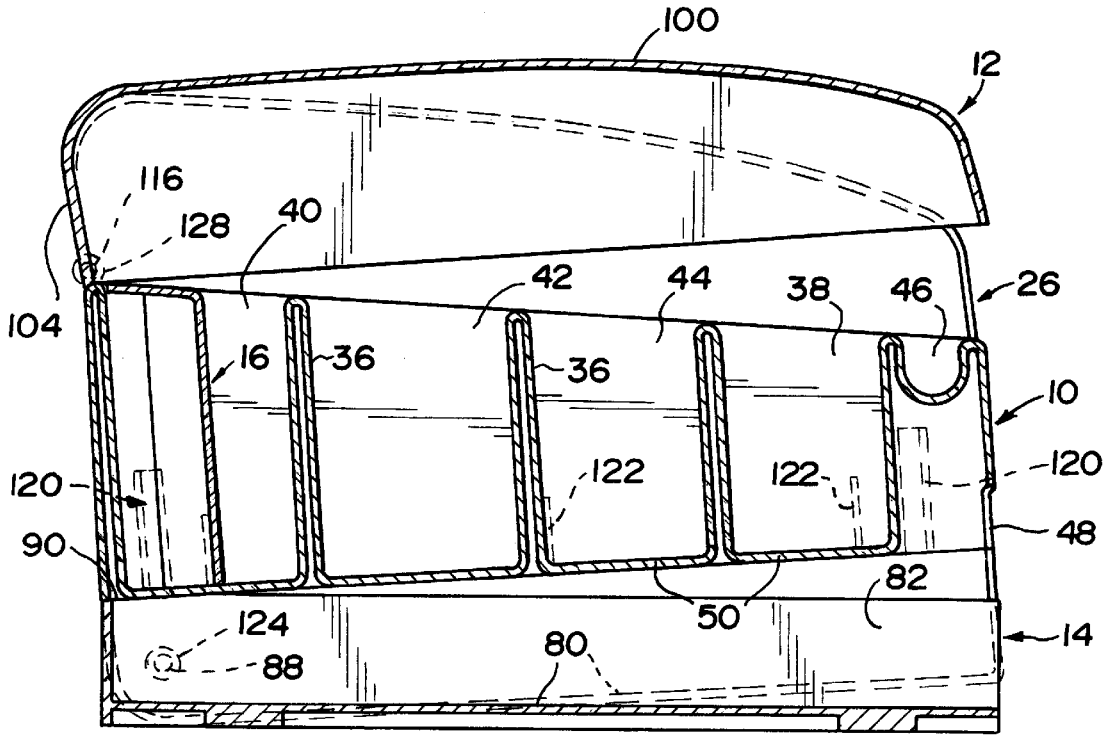
FIG. 12 is a cross-sectional detail similar to FIG. 11 with the lid partially open and the underlying shelf pivoted to its open position relative to the tray.

Noting FIGS. 11 and 12, the slight downward and rearward inclination of the upper edges of the shelf side walls 82 toward the rear thereof, as indicated at 90, allows for a slight and controlled pivotal opening of the forward portions of the tray 10 and shelf 14 relative to each other as a means for facilitating introduction and removal of magazines. The "opened" shelf will also be seen in FIG. 8.

The side panels 22 are used to mount the tray and shelf in the desired assembled relationship. Accordingly, each of the side panels 22 is of a vertical height and includes a sloping upper edge conforming to the configuration and height of the stacked tray 10 and shelf 14 as best seen in FIG. 6. The inner face of each side panel 22, in addition to the peripheral flange 92, includes a pair of mounting brackets 94 which duplicate the previously described brackets 70 with regard to shape, degree of projection, and the like. The brackets 94 differ only in the positioning of the brackets at a height appropriate to engage within the tray side wall slots 54 above the shelf 14. As such, the brackets 94 are positioned below the upper edges of the side panels 22 a distance substantially equal to that of the brackets 70 below the upper edges of the shorter side panels 18. In order to effectively lock the side panels 22 to the side walls 20 of the "elevated" tray 10, appropriate cams or camming wedges 96, duplicating the wedges 76, are also at an elevated position and appropriately located relative to the brackets 94 as to achieve the desired wedged locking effect.

The side panels 22, mounted to and rigidified by the tray 10, in turn pivotally mount the shelf 14 by the provision of opposed inwardly extending pivot sockets 98 positioned toward the lower rear corner of the side panels 22 and receiving the laterally projecting shelf pivot pins 88 therein.

With continued reference to the side panels 22, the accent groove illustrated in the outer face of each of these panels, which may in fact also be provided in any of the other side panels, is of particular interest in that one preferred manner of forming the brackets 70, in an injection molding process, requires the provision of openings through the side panels in alignment with the brackets. These openings can be hidden in or disguised by the two vertical extents of the accent groove which align with the corresponding brackets 70 extending from the inner face of the corresponding side panel. In other words, the mold facilitating openings will be formed within the accent groove itself and not be readily discernible. As an additional decorative feature, that portion of the side panel within the accent groove can be slightly outwardly enlarged to provide a "pillow" effect.

The assembled components, best seen in FIG. 6 form an organizer of enhanced versatility with the underlying magazine shelf 14 able to easily accommodate one or more television programming magazines or the like. The introduction and removal of the magazines is facilitated by the unique capability of pivotally adjusting the forward portions of the overlying tray and underlying shelf relative to each other as suggested in FIG. 8.

Figure 5:
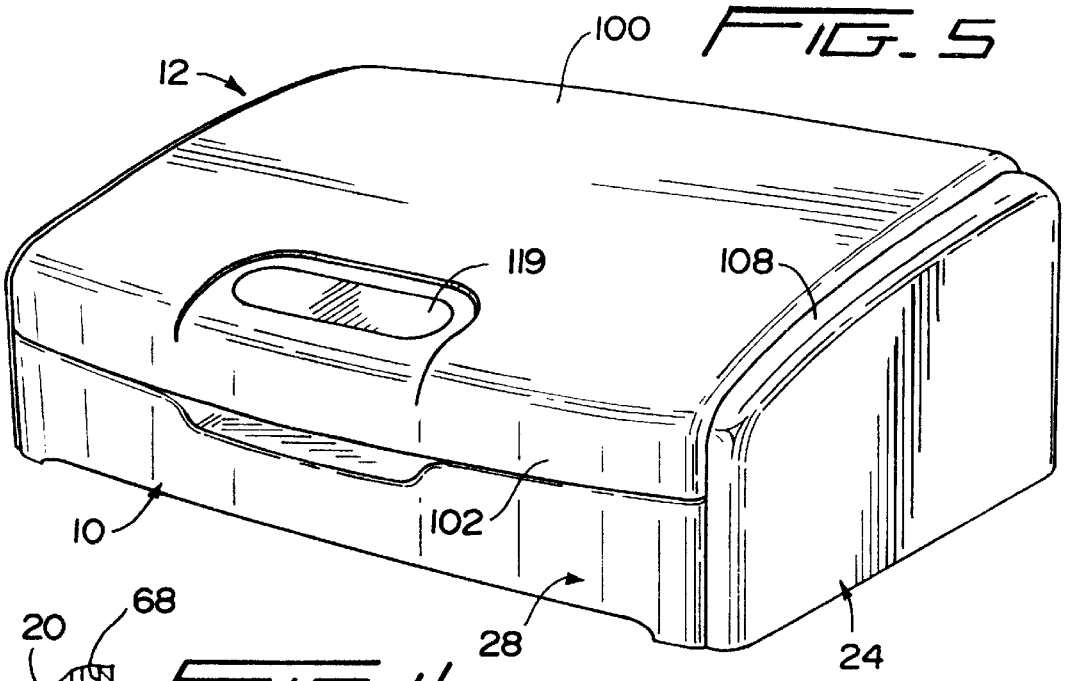
FIG. 5 is a perspective view of the organizer with a pivoting lid mounted on the tray by the side panels.

Referring now to FIG. 5 in particular, and considering the details illustrated in FIGS. 1 and 7, another contemplated assembly of selected ones of the components involves the provision of the basic tray 10 with a cover 12. The cover 12 includes a front to rear arced top panel 100 extending from a front wall 102 to a higher rear wall 104, and opposed side walls 106. The cover walls present lower edges which are coextensive with and seat on the upper edges of the tray walls therebelow. The cover 12 is to open by pivoting upwardly and rearwardly from the tray front wall 28 with the lower edge of the cover front wall 102 being easily accessible through the transverse slot centrally in the upper edge of the tray front wall 28.

The tray and cover of the assembly of FIG. 5 are mounted in operative relation to each other by the side panels 24. The side panels 24 are of a height and configuration, including a slightly arcing upper flanged edge 108, as to conform to the side walls 20 and 106 of the tray 10 and cover 12 respectively. In order to assemble to the tray 10, the inner faces of the side panels 24 include mounting brackets 110 and camming wedges 112 which substantially duplicate the size, configuration and positioning of the mounting brackets 70 and the camming wedges 76 of the initially described side panels 18.

The inner sides or faces of the side panels 24, at a height corresponding to the upper edges of the tray side walls 20 when the side panels 24 are fully mounted to the tray, include an integral front to rear rigidifying or stabilizing flange 114. The portions of the side panels 24 above the flanges 114 correspond to the configuration of the opposed side walls 106 of the cover 12. The cover 12 is in turn mounted to and between the side panels 24 by means of a pair of pivot pins 116 extending laterally outward from the opposed cover side walls 106 at the lower rear corners thereof. These pivot pins 116 are received within pivot sockets 118 integral with and projecting inwardly from the inner faces of the side panels 24 at the rear edges thereof immediately above the stabilizing flange 114. The details of this relationship will be seen in FIG. 7. FIGS. 11 and 12 illustrate, in section, the pivotal movement of the cover between its closed position and a partially open position. The cover, to provide for full access to the tray compartments, will open at least approximately 100° as suggested in FIG. 10.

Referring again to FIG. 5, the cover provides a particularly convenient surface for further customizing the organizer by the imprinting or attaching thereto of a company or customer logo or name. In this regard, note the oblong area 119 which can be formed by a removable insert in the plastic injection mold for the lid which will enable a direct imprinting of a logo. This area can also receive a custom metal name plate attached by an appropriate adhesive.

A further assemblage, noting FIGS. 8–12, as well as the component details of FIG. 1, comprises the base tray 10, underlying shelf 14 and overlying pivoted cover 12, all retained in operative position by the side panels 26. The tray 10, shelf 14 and cover 12 stack or are positioned as previously described with the separate pairs of components and the respective side walls aligning and engaging.

The side panels 26 are of a height and configuration substantially the same as that of the combined side walls of the three stacked components.

On the inner side of the larger side walls 26, the mounting brackets 120 and cams 122 are positioned to engage the tray side walls 20 in the manner previously described at the elevated position required by the underlying shelf 14. As such, the brackets 120 and cams 122 are positioned from the lower flanged edge of the side panels 26 in the same manner as the brackets 94 and cams 96 of the side panels 22. The side panels 26, at or adjacent the lower rear corner, include inwardly projecting pivot sockets 124 equivalent to the previously described sockets 98 and similarly pivotally receiving the pivot pins 88 therein for the desired mounting of and relative adjustment between the tray 10 and the shelf 14.

The side panels 26, similar to the side panels 24, also include a stabilizing flange 126 which aligns with the upper edges 34 of the tray side walls 20. The configuration of the side panels 26 above the flange 126 conforms to the equivalent upper portion of the side panels 24 and the opposed side walls 106 of the cover 12. The side panels 26 also include inwardly projecting pivot sockets 128 at the rear edges thereof and immediately above the stabilizing flange 126 so as to rotatably receive the pivot pins 116 projecting from the opposed side walls 106 of the cover 12.

Figure 9:
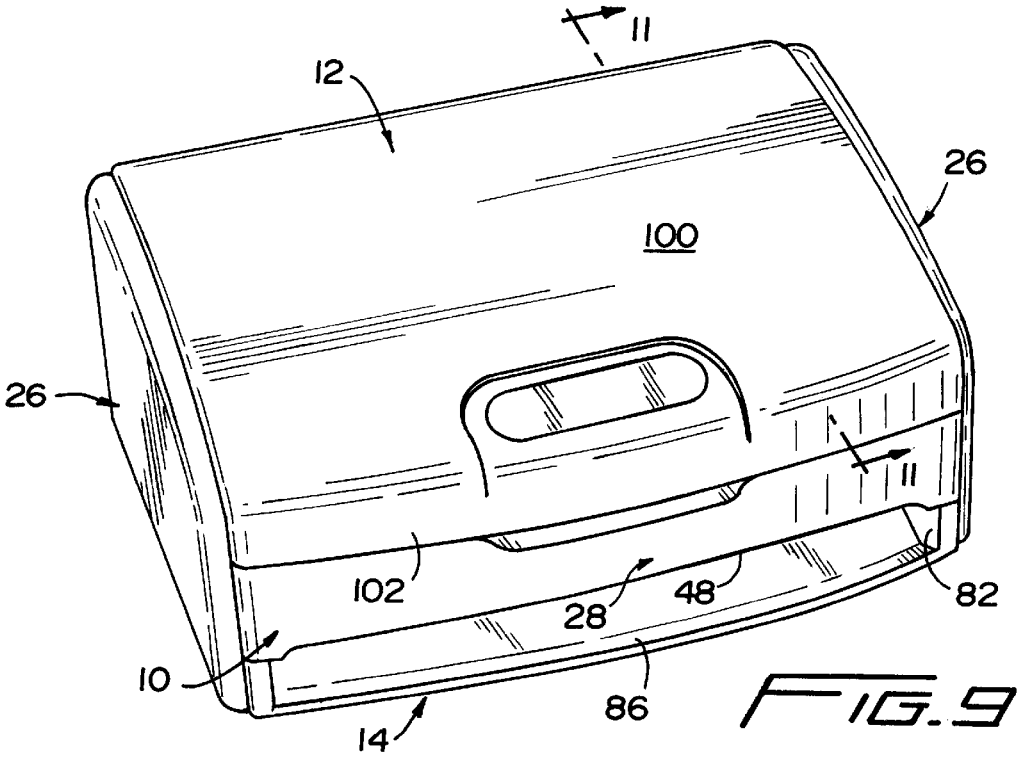
FIG. 9 is a perspective view of the organizer of FIG. 8 with the cover closed and the underlying shelf pivoted to its nested position.
Figure 10:
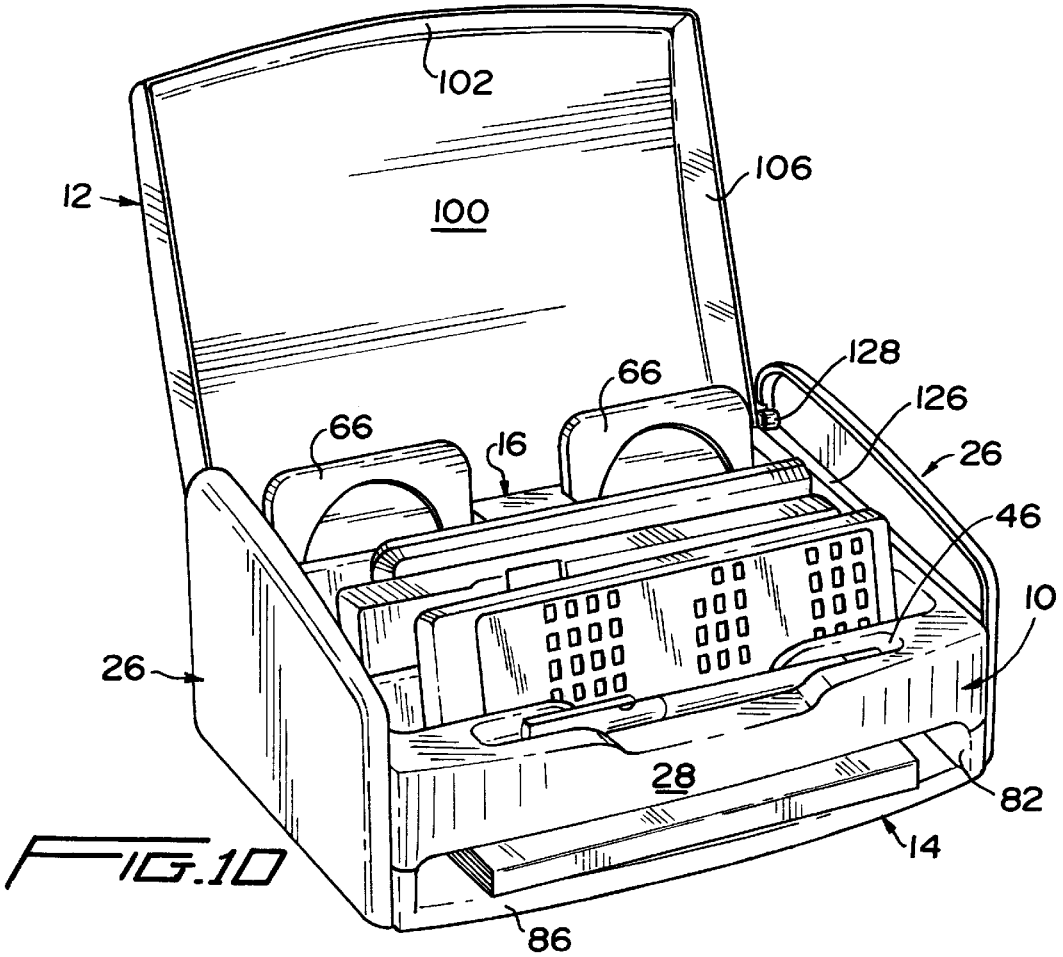
FIG. 10 is a perspective view of the organizer of FIG. 8 with various TV accessories mounted therein.

This assembly of components, with the cover, tray and shelf in the closed positions thereof, is illustrated in FIGS. 9 and 11. FIGS. 8, 10 and 12 illustrate the tray, cover and shelf fully or partially open.

From the foregoing, it will be appreciated that a unique assemblage or kit has been presented which allows for the customized construction of a series of organizers, each of which is individually unique. The assemblage includes three basic components, a compartmented tray, a shelf and a cover, with the tray selectively mounting a removable compartment divider. The variety of organizers assembled from the components relies on a series of specifically configured sets of side panels. The sets being specifically adapted to accommodate the tray alone, the tray and shelf, the tray and cover, or the tray and both the shelf and the cover. In each instance, the selected set of side panels forms finished sides to the organizer with the components, and more particularly the operating or pivoting portions thereof, mounted to and confined between the side panels.

The foregoing is illustrative of the principles of the invention, and are considered to encompass all variations thereof as may fall within the scope of the claims following hereinafter.

I claim:

1. An organizer for television accessories, said organizer comprising a tray defining a base and including opposed side walls and opposed front and rear walls joined to and extending between said side walls, a plurality of compartments extending transversely across said tray between said side walls, said compartments being substantially parallel to each other and sequentially located between said front wall and said rear wall, said compartments being progressively deeper between said front wall and said rear wall, said front wall being of a predetermined height, and said rear wall being higher than said front wall, said compartments being defined by a plurality of substantially parallel intermediate walls extending transversely across said tray between said side walls, said intermediate walls being progressively higher between said front wall and said rear wall, said opposed side walls each including an upper edge inclined from said front wall to said higher rear wall and conforming to the progressively higher intermediate walls, said intermediate walls each having an upper edge along the length thereof between said side walls, said upper edges of said side walls and said intermediate walls being in a substantially common plane inclined from said rear wall to said front wall, said front wall having an upper edge, an elongate pocket for writing implements in and along said front wall upper edge, said front wall upper edge and said intermediate wall upper edges each having a central elongate recess therein.

2. The organizer of claim 1 wherein one of said compartments, comprising a rear compartment, is immediately adjacent and partially defined by said rear wall, a removable divider received within said rear compartment, said divider including a longitudinal partition extending along said rear compartment and having opposed ends adjacent said opposed side walls, a first central partition joined to and extending forwardly from said longitudinal partition at a location centrally between said opposed ends of said longitudinal partition and defining therewith a pair of chambers, one to each side of said central partition, and a pair of end partitions joined to and extending rearwardly from said longitudinal partition adjacent said opposed ends of said longitudinal partition and defining therebetween a single chamber.

3. The organizer of claim 1 including side panels, one overlying each of said side walls immediately outward thereof relative to said compartments, and panel mounting means for releasably securing said side panels to said side walls.

4. The organizer of claim 3 wherein said panel mounting means comprises vertical slots defined in each tray side wall and opening through lower edges thereof, mounting brackets on and projecting inward from said side panels in alignment with said slots and vertically received within said slots, and retaining means for fixing said mounting brackets within said slots to preclude accidental withdrawal therefrom.

5. The organizer of claim 4 wherein each mounting bracket includes a generally flat portion received through the corresponding side wall slot and projecting slightly inward thereof and terminating in a laterally directed extension closely slidable on the corresponding side wall, said retaining means comprising camming wedges on each side panel, laterally of the mounting brackets on the corresponding side panel and projecting inwardly into engagement with the corresponding side wall to the opposite side thereof from said mounting bracket extensions, said camming wedges having outer camming surfaces applying progressively greater pressure on the side walls as the brackets slide inward of the slots wherein said bracket extensions are firmly brought into engagement with said side walls.

6. The organizer of claim 4 wherein said side walls of said tray include outer surfaces with vertical alternating ribs and grooves defined therein and of a height at least equal to that of said slots.

7. The organizer of claim 3 wherein said side panels depend below said side walls and said tray base, and a shelf below said tray and opening forward below said tray front wall to form an entry to said shelf, said shelf extending between said side panels, and shelf mounting means on said shelf and side panels for mounting said shelf on said side panels.

8. The organizer of claim 7 wherein said shelf mounting means comprises pivot means on each side panel toward the rear of the tray and on an adjacent portion of said shelf wherein said tray, at said front wall, is selectively upwardly adjustable relative to said shelf to enlarge said entry.

9. The organizer of claim 8 wherein said side panels extend above said tray side walls, a cover selectively overlying said tray between said rear wall and said front wall and covering said compartments, and pivot means on said side panels and said cover above said tray side walls and adjacent said tray rear walls for mounting said cover on said side panels for movement between a first closed position covering said compartments and a second open position pivoted upward and rearwardly relative to said compartments.

10. The organizer of claim 9 wherein said panel mounting means comprises vertical slots defined in each tray side wall and opening through lower edges thereof, mounting brackets on and projecting inward from said side panels in alignment with said slots and vertically received within said slots, and retaining means for fixing said mounting brackets within said slots to preclude accidental withdrawal therefrom.

11. The organizer of claim 8 wherein said tray front wall has a lower edge with an upwardly offset recess along the length thereof generally coextensive with the entry to said shelf wherein enhanced access to said entry is defined.

12. The organizer of claim 3 wherein said side panels extend above said tray side walls, a cover selectively overlying said tray between said rear wall and said front wall and covering said compartments, and pivot means on said side panels and said cover above said tray side walls and adjacent said tray rear walls for mounting said cover on said side panels for movement between a first closed position covering said compartments and a second open position pivoted upward and rearwardly relative to said compartments.

13. An organizer for television accessories, said organizer comprising a tray defining a base and including opposed side walls and opposed front and rear walls joined to and extending between said side walls, a plurality of compartments extending transversely across said tray between said side walls, said compartments being substantially parallel to each other and sequentially located between said front wall and said rear wall, said compartments being progressively deeper between said front wall and said rear wall, a removable divider received within a selected compartment, said divider including a longitudinal partition extending along said selected compartment and having opposed ends adjacent said opposed side walls, a central partition joined to and extending forwardly from said longitudinal partition at a location centrally between said opposed ends and defining a pair of chambers, one to each side of said central partition, and a pair of end partitions joined to and extending rearward from said longitudinal partition adjacent said opposed ends of said longitudinal partition and defining therewith a single elongate chamber.

14. An organizer for television accessories, said organizer comprising a tray defining a base and including opposed side walls and opposed front and rear walls joined to and extending between said side walls; a plurality of compartments extending transversely across said tray between said side walls, said compartments being substantially parallel to each other and sequentially located between said front wall and said rear wall; side panels, one overlying each of said side walls immediately outward thereof relative to said compartments, and panel mounting means for releasably securing said side panels to said side walls, said panel mounting means comprising vertical slots defined in each tray side wall and opening through lower edges thereof, mounting brackets on and projecting inward from said side panels in alignment with said slots and vertically received within said slots, and retaining means for fixing said mounting brackets within said slots to preclude accidental withdrawal therefrom, each mounting bracket including a generally flat portion received through the corresponding side wall slot and protecting slightly inward thereof and terminating in a laterally directed extension closely slidable on the corresponding side wall, said retaining means comprising camming wedges on each side panel, laterally of the mounting brackets on the corresponding side panel and protecting inwardly into engagement with the corresponding side wall to the opposite side thereof from said mounting bracket extensions, said camming wedges having outer camming surfaces applying progressively greater pressure on the side walls as the brackets slide inward of the slots wherein said bracket extensions are firmly brought into engagement with said side walls.

15. An organizer for television accessories, said organizer comprising a tray defining a base and including opposed side walls and opposed front and rear walls joined to and extending between said side walls, a plurality of compartments extending transversely across said tray between said side walls, said compartments being substantially parallel to each other and sequentially located between said front wall and said rear wall, said compartments being progressively deeper between said front wall and said rear wall, said organizer further including side panels, one overlying each of said side walls immediately outward thereof relative to said compartments, and panel mounting means for releasably securing said side panels to said side walls, said panel mounting means comprising vertical slots defined in each tray side wall and opening through lower edges thereof, mounting brackets on and protecting inward from said side panels in alignment with said slots and vertically received within said slots, and retaining means for fixing said mounting brackets within said slots to preclude accidental withdrawal therefrom, said side panels depending below said side walls and said tray base, and a shelf below said tray and opening forward below said tray front wall to form an entry to said shelf, said shelf extending between said side panels, and shelf mounting means on said shelf and side panels for mounting said shelf on said side panels, said shelf mounting means comprising pivot means on each side panel toward the rear of the tray and on an adjacent portion of said shelf wherein said tray, at said front wall, is selectively upwardly adjustable relative to said shelf to enlarge said entry.

16. An organizer for television accessories, said organizer comprising a tray defining a base and including opposed side walls and opposed front and rear walls joined to and extending between said side walls, a plurality of compartments extending transversely across said tray between said side walls, said compartments being substantially parallel to each other and sequentially located between said front wall and said rear wall, said compartments being progressively deeper between said front wall and said rear wall, said front wall being of a predetermined height, and said rear wall being higher than said front wall, said compartments being defined by a plurality of substantially parallel intermediate walls extending transversely across said tray between said side walls, said intermediate walls being progressively higher between said front wall and said rear wall, said front wall having an upper edge, an elongate pocket for writing implements in and along said front wall upper edge, said front wall upper edge and said intermediate wall upper edges each having a central elongate recess therein.

17. An organizer for television accessories, said organizer comprising a tray defining a base and including opposed side walls and opposed front and rear walls joined to and extending between said side walls, a plurality of compartments extending transversely across said tray between said side walls, said compartments being substantially parallel to each other and sequentially located between said front wall and said rear wall, said compartments being progressively deeper between said front wall and said rear wall, said organizer further including side panels, one overlying each of said side walls immediately outward thereof relative to said compartments, and panel mounting means for releasably securing said side panels to said side walls, said side panels depending below said side walls and said tray base, and a shelf below said tray and opening forward below said tray front wall to form an entry to said shelf, said shelf extending between said side panels, and shelf mounting means on said shelf and side panels for mounting said shelf on said side panels, said shelf mounting means comprising pivot means on each side panel toward the rear of the tray and on an adjacent portion of said shelf wherein said tray, at said front wall, is selectively upwardly adjustable relative to said shelf to enlarge said entry.

* * * * *